US006966639B2

(12) United States Patent
Martinez-Pacheco

(10) Patent No.: US 6,966,639 B2
(45) Date of Patent: Nov. 22, 2005

(54) INK CARTRIDGE AND AIR MANAGEMENT SYSTEM FOR AN INK CARTRIDGE

(75) Inventor: Adrian Martinez-Pacheco, Villa Carolina, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 50 days.

(21) Appl. No.: 10/352,688

(22) Filed: Jan. 28, 2003

(65) Prior Publication Data

US 2004/0145638 A1 Jul. 29, 2004

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 4,234,017 A * 11/1980 Mercier ..... 138/30
5,040,001 A 8/1991 Dunn et al.
5,409,134 A * 4/1995 Cowger et al. ..... 222/1
5,515,092 A 5/1996 Swanson et al.
5,988,803 A 11/1999 Komplin et al.
6,174,053 B1 * 1/2001 Higuma et al. ..... 347/86
6,196,669 B1 3/2001 Harvey et al.
6,206,515 B1 3/2001 Swanson et al.
6,247,806 B1 6/2001 Matsumoto et al.
6,293,666 B1 * 9/2001 Mou et al. ..... 347/87

* cited by examiner

*Primary Examiner*—Anh T. N. Vo

(57) ABSTRACT

In one representative embodiment of the invention an ink cartridge includes a housing defining a first fluid reservoir, and an air management system having a fitment supported by the housing. The air management system also includes an expansible bladder which defines a second fluid reservoir and which is supported by the fitment within the first fluid reservoir. The expansible bladder is configured to expand to thereby increase the second fluid reservoir from a first volume to a second volume. The expansible bladder is fabricated from a material having a shape-memory to thereby bias the expansible bladder towards the first volume.

12 Claims, 6 Drawing Sheets

INK CARTRIDGE AND AIR MANAGEMENT SYSTEM FOR AN INK CARTRIDGE

BACKGROUND

Imaging apparatus are primarily provided in two different configurations—liquid ink imaging apparatus and dry toner imaging apparatus. As used herein, "imaging apparatus" includes any type of apparatus which is configured to generate an image on a sheet of imaging media (such as paper or the like), and includes printers, photocopiers, facsimile machines, and combinations thereof (i.e., so-called "multi-function printers"). Liquid ink imaging apparatus are commonly known as "ink-jet imaging apparatus" because tiny droplets of liquid ink are projected from a print head onto a sheet of imaging media to form an image. Liquid ink is provided to ink-jet imaging apparatus by an ink delivery system, which is typically either a single-use replaceable cartridge or a tank that is resident within the imaging apparatus and which is refilled periodically from a larger reservoir.

Regardless of which type of ink delivery system is used, one of the main goals is to reduce (and preferably eliminate) extraneous ink from dripping or "drooling" out of the print head. Two primary designs are used to achieve this objective. The first design is to use a capillary foam to entrain the liquid ink, wherein the capillary action of the foam is sufficient to overcome gravitational forces which would otherwise tend to cause the ink to drip or drool from the print head. The second design is to use a negative pressure system (or "air management system") to impart a slight negative pressure (i.e., a pressure slightly lower than ambient atmospheric pressure) on the liquid ink, thereby biasing ink flow into the reservoir until acted on by the print head, thus forcing the ink out of the reservoir. Another primary objective in ink delivery systems is to reduce (and preferably, eliminate) any entrained air from entering the liquid ink, which can adversely affect performance of the imaging apparatus and the resultant image quality. One of the more common types of negative pressure system utilizes an expansible bag or bladder which is placed within the ink reservoir. Such a system is depicted in FIG. 1 (described below). These prior art bladders typically include a separate metal spring, generally in the shape of a shaped plate, which facilitates in biasing wall members of the bladder either towards or away from one another.

The prior art designs are generally effective in reducing or eliminating ink drool from the print head of an ink cartridge. However, the metal spring members which are used to bias the bladder walls to predetermined positions relative to one another can sometimes puncture the bladder during assembly, rendering the cartridge useless. Further, a separate spring member adds to the complexity of the design and the construction of the bladder system. Further, prior art air management systems are generally complex, having a relatively large number of parts and requiring a relatively intense fabrication process.

What is needed then is a liquid ink containment and delivery system for use in liquid ink imaging apparatus which achieves the benefits to be derived from similar prior art devices, but which avoids the shortcomings and detriments individually associated therewith.

SUMMARY

In one representative embodiment of the invention an ink cartridge includes a housing defining a first fluid reservoir, and an air management system having a fitment supported by the housing. The air management system also includes an expansible bladder which defines a second fluid reservoir and which is supported by the fitment within the first fluid reservoir. The expansible bladder is configured to expand to thereby increase the second fluid reservoir from a first volume to a second volume. The expansible bladder is fabricated from a material having a shape-memory to thereby bias the expansible bladder towards the first volume.

Another embodiment provides for an air management system for use in an ink cartridge. The air management system includes a fitment section configured to be supported by the ink cartridge, and an expansible bladder section which integrally extends from the fitment section and which defines a fluid reservoir. The expansible bladder section is configured to expand to thereby increase the fluid reservoir from a first volume to a second volume. The air management system is fabricated from a material having a shape-memory to thereby bias the expansible bladder section towards the first volume.

These and other aspects and embodiments of the present invention will now be described in detail with reference to the accompanying drawings, wherein:

DETAILED DESCRIPTION

As described above, certain prior art ink cartridges for use in imaging apparatus include a bladder (either an expansible bladder or a collapsible bladder) which facilitates in governing the flow of ink to a print head used to apply the liquid ink to a sheet of imaging media. The prior art bladders can be used either to contain the liquid ink itself, or to contain air which displaces the liquid ink as the ink is consumed from the cartridge. Further, these prior art bladders typically include a separate metal spring, generally in the shape of a shaped plate, which facilitates in biasing wall members of the bladder either towards or away from one another. As also described above, the prior art air management systems tend to be complex in the number of components used in the system, and the number of fabrication steps required to assemble the system. The present invention provides for an air management system for use in a liquid ink cartridge which includes a reduced number of components. Embodiments of the present invention are particularly useful in applications where the air management system is used to fill the void created by depleted ink as the ink is removed from an ink cartridge during normal use.

Figure 1:
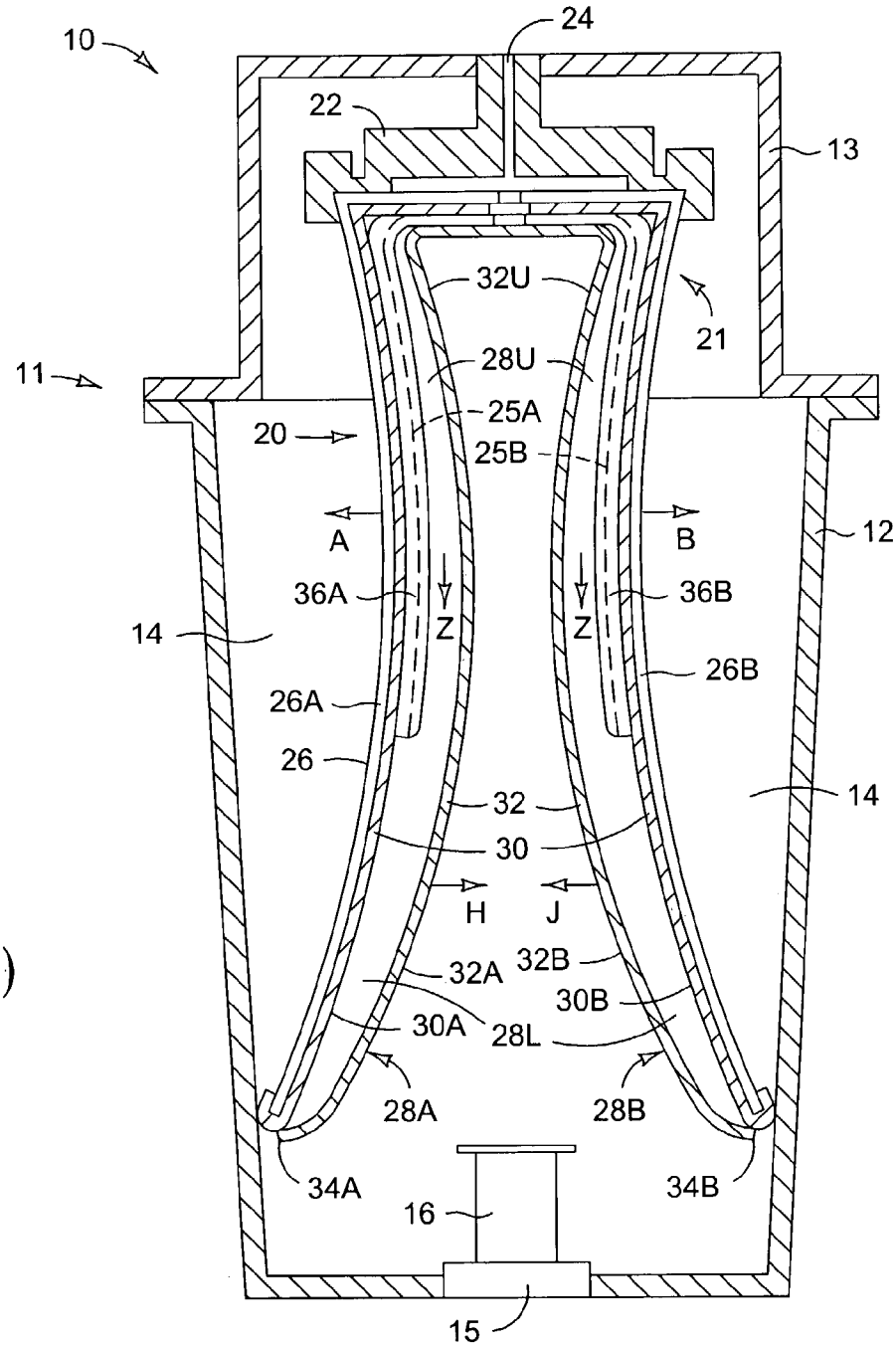
FIG. 1 (Prior Art)
FIG. 1 is a side sectional view depicting a prior art liquid ink cartridge and a prior art air management system.

FIG. 1 is a side sectional view of a prior art ink cartridge 10 which includes a housing 11 that has a top portion 13 and a bottom portion 12. The top portion 13 is typically joined to the bottom portion 12 during assembly by gluing or fusing the portions together. The housing bottom portion 12 defines an ink reservoir 14, and supports a print head 15. A standpipe 16 admits ink from the ink reservoir 14 into the print head. The standpipe 16 can be fabricated in-part from a fine mesh which resists the flow of air from the print head 15 into the ink reservoir 14. The ink cartridge 10 further includes an expansible bladder-type negative pressure system 20 which is supported by a fitment 22, which is in turn supported by the housing upper portion 13. The expansible bladder 20 and the fitment 22 together make up an air management system 21. During assembly of the ink cartridge 10 the negative pressure system 20 is placed within the ink reservoir 14 in the housing lower portion 12 as the upper portion 13 and housing lower portion 12 are joined together.

The negative pressure system 20 depicted inn FIG. 1 includes two expansible bladders 28A and 28B. Each expansible bladder 28A, 28B is made from a flexible, impermeable film, such as a polyethylene film, so that the bladders can contain air. More specifically, in fabricating the bladders 28A and 28B a first polyethylene film 30 is laid on top of a second polyethylene film 32, and the films are then sealed to one another along their open peripheral edges. The attached films 30, 32 are then generally folded in half, producing first expansible bladder 28A having sidewalls 30A and 30B, and second expansible bladder 28B having sidewalls 30B and 32B. The folded bladder assembly 20 is secured to the fitment 22. An airway opening 24 in the fitment 22 allows ambient air to move into the expansible bladders 28A, 28B. During fabrication of the bladders 28A, 28B a metal spring 26 is also secured to the outer film layer 30. This can be accomplished by using heat and/or adhesives. Consequently, when the film/spring assembly is "folded" into the shape depicted in FIG. 1, the spring 26 produces a first spring member 26A associated with bladder 28A, and a second spring member 26B associated with bladder 28B. The spring 26 biases the outer film layer 30 in directions "A" and "B" so that the ends 34A and 34B of respective bladders 28A and 28B are pressed against the inner wall of the housing lower portion 12. However, the inner film layer 32 is free to move inward in directions "H" and "J". When the bladders 28A, 28B are initially installed in the housing 11, the inner film layer 32 is in contact with the outer film layer 30. As ink is consumed from the ink reservoir 14, the pressure within the ink reservoir drops, causing inner film layers 32A and 32B to move in respective directions "H" and "J". In order to facilitate separation of the two film layers 30, 32 as the pressure within the ink reservoir 14 drops, an airway can be inserted into each bladder (airway 36A in bladder 28A, and airway 36B in bladder 28B). The airways 36A and 36B are in fluid communication with the airway opening 24, allowing ambient air to flow into the bladders 28A, 28B. More specifically, airways 36A and 36B have respective longitudinal channels 25A and 25B (indicated by hidden lines) formed therein. When the bladders 28A, 28B are in the initial, collapsed position and the upper portions 32U of the inner film layer 32 are in contact with the airways 36A and 36B, the channels 25A and 25B allow air to move in direction "Z" into the lower part 28L of the bladders 28A, 28B. When the airways 36A, 36B are not provided, it is possible for the lower part 28L of the bladders 28A, 28B to be cut-off from the upper part 28U of the bladders. The airways 36A, 36B prevent this by providing a channel 25A, 25B for air to move from the upper part 28U of the bladders 28A, 28B into the lower part 28L of the bladders.

In operation, as ink is removed from the ink reservoir 14 of the liquid ink cartridge 10, the expansible bladders 28A, 28B expand to fill the void created by the removed ink, so that the pressure of the remaining ink in the reservoir 14 does not become so low that ink will not flow out of the print head 15. More specifically, the bladder outer walls 30A and 30B will be biased in respective directions "A" and "B", but the bladder inner walls 32A, 32B will be free to move in respective directions "H" and "J", thus allowing bladders 28A and 28B to expand or inflate.

Figure 2:
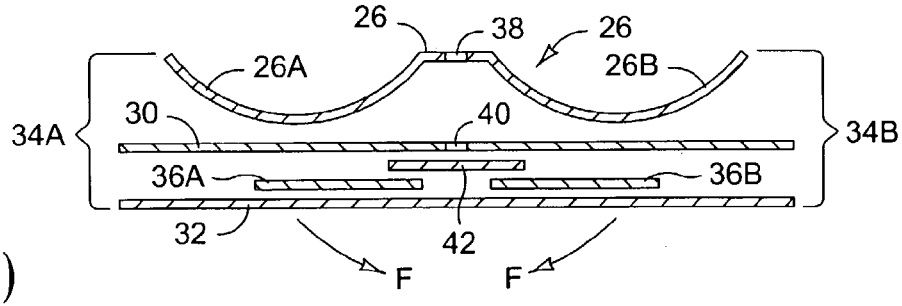
FIG. 2 (Prior Art)
FIG. 2 is an exploded side sectional view depicting selected prior art components that can be used in the air management system depicted in FIG. 1.

Turning to FIG. 2, a side sectional view of selected components which make up the expansible bladders 28A, 28B of FIG. 1 are depicted. Included are the inner film layer 32, the air passageways 36A and 36B, a release diaphragm 42, the outer film layer 30, and the spring member 26, which has arms 26A and 26B. The components are assembled in a stack, and secured (as by heat or gluing) at the ends 34A and 34B of the bladder components and along the edges of the film layers 30, 32. The assembled stack of components is then "folded" in directions "F" to produce the ink pressure control system 20 depicted in FIG. 1, except that in FIG. 1 the arms 26A, 26B of the spring 26 are compressed from their "at rest" position (i.e., arms 26A and 26B are pushed towards one another in directions "H" and "J" in FIG. 1). As can be seen, an air hole 38 is formed in the spring 26, and another air hole 40 is formed in the outer film layer 30. When the assembled bladder components are secured into the fitment 22 (FIG. 1), the air holes 38 and 40 (FIG. 2) align with the airway opening 24 (FIG. 1) to allow air to flow into the area between the film layers 30 and 32. A release dot 42, which is a silicon-coated or impregnated patch, is placed between the film outer layer 30 and the film inner layer 32 in the area where the outer layer 30 will be heat-attached to the fitment 22 (FIG. 1) to keep the two film layers 30, 32 from sticking to one another during the heat attachment process.

It will be appreciated that the thicknesses of the bladder components depicted in FIGS. 1 and 2 (e.g., inner and outer film layers 30 and 32, spring 26, and airways 36A and 36B) are exaggerated in the drawings to facilitate visualization of the components. In reality these components are typically very thin. For example the film layers 30 and 32 are typically polyethylene film having a thickness of 1.2 mils, while the metal spring member 26 can be only 5 to 10 mils in thickness.

As can be seen from FIGS. 1 and 2 and the foregoing discussion, the air management system 21 (FIG. 1) of the prior art includes a significant number of components (fitment 22, spring 26, film layers 30 and 32, airways 36A and 36B, and release diaphragm 42 (FIG. 2). The large number of components concomitantly requires a significant number of assembly steps, and also requires that all such components be kept on-hand. It is thus desirable to provide an air management system for an ink cartridge that has a fewer number of components.

Figure 3:
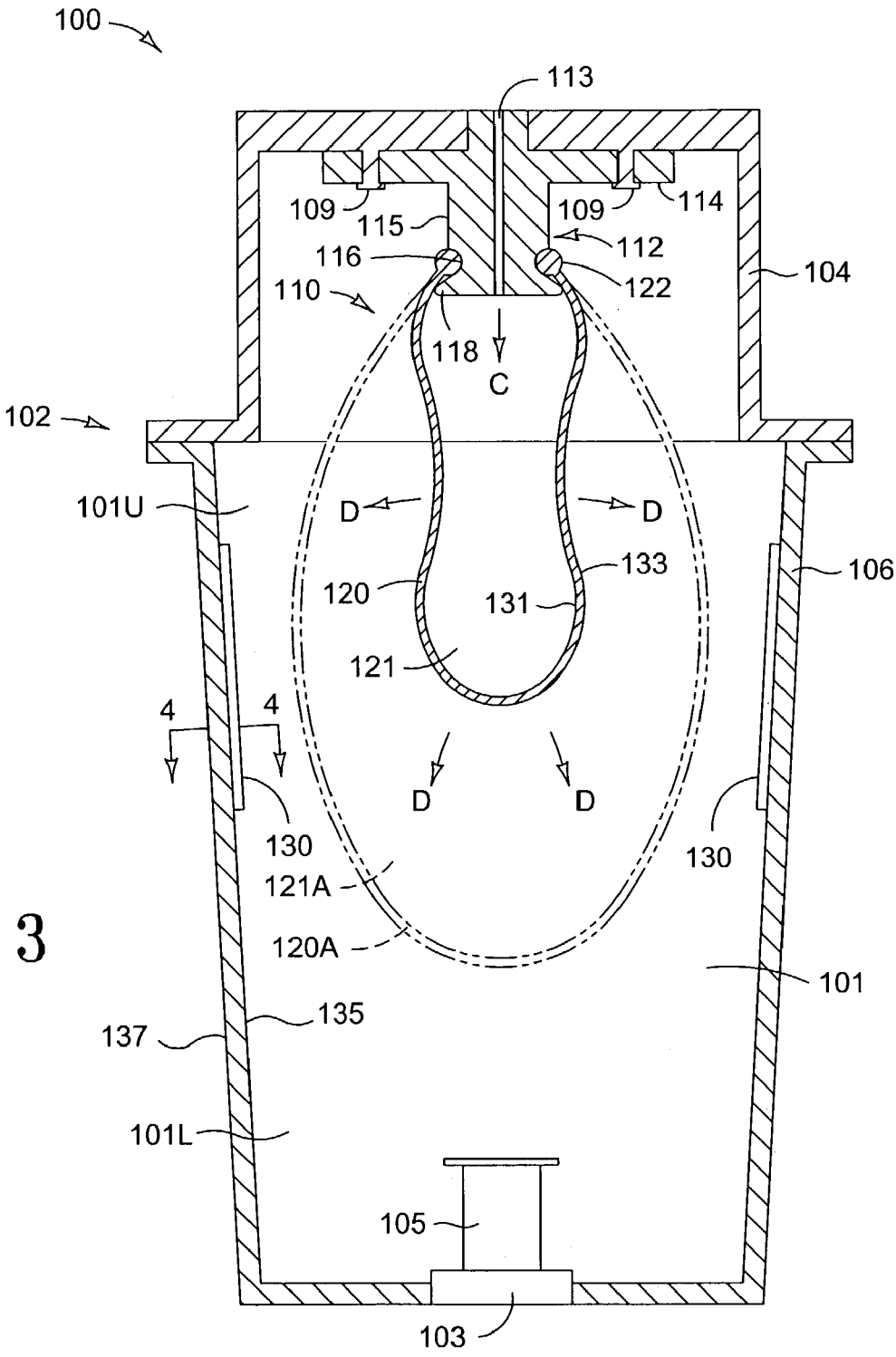
FIG. 3 is a side sectional view depicting a liquid ink cartridge and an air management system in accordance with one embodiment of the invention.

Turning to FIG. 3, a side sectional view depicts a liquid ink cartridge 100 having an air management system 110 in accordance with one embodiment of the invention. The ink cartridge 100 includes a housing 102 having an outer surface 137 and an inner surface 135 which defines a first fluid reservoir 101. The first fluid reservoir 101 is configured to contain liquid ink (not shown). As depicted, the housing 102 includes an upper portion 104 and a lower portion 106, which are configured to be joined together by fusing or gluing, or any other method designed to provide a liquid-tight seal between the upper portion 104 and the lower portion 106. The lower portion 106 of the housing 102 further supports a print head 103 and a standpipe 105, which function in like manner as the print head 15 and standpipe 16 described above with respect to FIG. 1.

The ink cartridge 100 of FIG. 3 is provided with an air management system 110 which includes a fitment 112 that is supported by the housing upper portion 104, and a one-piece expansible bladder 120 which is supported by the fitment 112 within the first fluid reservoir 101. The fitment 112 includes a flange portion 114 which can be secured to the housing upper portion 104 by studs 109. The studs 109 can be extensions of the housing upper portion 104, and can be heated and deformed to secure the flange portion 114 of the fitment 112 against the inner surface of the upper housing portion 104. As depicted, the fitment 112 further includes an extension portion 115, a flared portion, 118, and a recess portion 116 defined between the extension portion 115 and the flared portion 118. With this configuration the one piece expansible bladder 120 can include an elastomeric ring portion 122 defining an opening into the expansible bladder, and the elastomeric ring portion 122 of the expansible bladder can be fitted about the recess portion 116 of the fitment 112. That is, the one-piece expansible bladder can resemble a balloon. This configuration allows for ease of assembly of the air management system 110 as the ring portion 122 of the bladder 120 merely needs to be slipped over the flared portion 118 of the fitment.

The one-piece expansible bladder 120 of the air management system 110 defines a second fluid reservoir 121, which is configured to contain air. The fitment 112 is provided with a vent hole 113 to thereby vent the second fluid reservoir 121 to atmosphere. The bladder 120 is configured to expand (as indicated by expanded bladder 120A shown in phantom lines) to thereby increase the second fluid reservoir from a first volume 121 to a second volume 121A. That is, as ink is removed from the first fluid reservoir 101 during use of the ink cartridge 100, ambient air moves in direction "C" through the air vent 113 and into the bladder interior 121, and the bladder 120 expands to fill the void left by the removed ink. Further, the expansible bladder 120 is fabricated from a material having a shape-memory to thereby bias the expansible bladder towards the first volume 121 (i.e., in a direction opposite to the arrows "D"). In this way, a slight negative pressure is maintained on ink within the first fluid reservoir 101. Materials that can be used to fabricate the expansible bladder include natural rubber, neoprene rubber, nitrile rubber, isobutylene-isoprene, chlorosulphonated polyethylene, viton, silicone rubber, acrylnitrile butadiene, ethylene-propylene, sytrol-butadiene, and flourosilicone. The selected material should have the shape-memory properties previously described, and should also be chemically resistant to deterioration from exposure to ink in the first fluid reservoir 101, and from brittleness due to exposure to air contained in the second reservoir 121 defined by the bladder 120.

The expansible bladder 120 is defined by an inner surface 131 and an outer surface 133. The outer surface 133 of the expansible bladder 120 is intended to be exposed to (and in contact with) ink in the first fluid reservoir 101. Thus, the removal of ink from the first fluid reservoir 101 creates a negative-pressure condition within the ink cartridge 100, thus causing the bladder 120 to expand in directions "D". However, the shape-memory characteristics of the material from which the expansible bladder 120 is fabricated avoids pressure equalization between the ink in the reservoir 101 and the ambient pressure (outside of the ink reservoir), thus maintaining a slight negative pressure within the ink reservoir 101. As described previously, a slight negative pressure in the ink reservoir 101 is desirable to reduce ink "drool" from the print head 103. Further, by venting the air chamber 121 of the expansible bladder 120 to the atmosphere via the air vent 113 in the fitment 112, as ink in the ink reservoir 101 expands and contracts due to changes in temperature of the ink, a constant pressure will be maintained in the ink reservoir 101, as established by the shape-memory characteristics of the material from which the expansible bladder 120 is fabricated. In one example, the expansible bladder 120 is configured to expand in directions "D" when the outer surface 133 of the bladder is subjected to a pressure of between about 0.01 psi and 0.50 psi.

Figure 4:
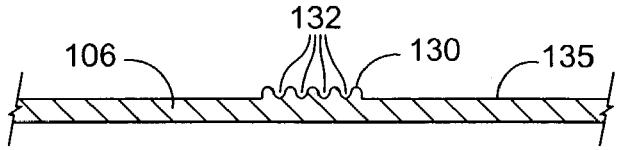
FIG. 4 is a plan sectional detail of the ink cartridge of FIG. 3, depicting a fluid passageway formed on the inner surface of the ink cartridge housing.

As can be seen in the embodiment depicted in FIG. 3, if the expansible bladder 120 continues to expand in directions "D" it is possible that the outer surface 133 of the bladder 120 can contact the inner surface 135 of the housing, potentially sealing off the upper portion 101U of the first fluid reservoir 101 from the lower portion 101L of the reservoir 101. In this case ink can become trapped in the upper portion 101U of the reservoir 101. To address this possibility, the ink cartridge housing 102 can be provided with a raised portion 130 on the inner surface 135 of the housing. The raised portion 130 can be shaped to define fluid passageways to allow liquid ink to drain from the upper portion 101U of the ink reservoir 101 to the lower portion 101L should the expansible bladder expand to contact the inner surface 135 of the housing 102. FIG. 4 is a plan sectional view of the ink cartridge housing lower portion 106, wherein the section is taken through the raised portion 130. As depicted, the raised portion 130 defines scallops which define fluid passageways 132.

In a variation on the embodiment of the ink cartridge depicted in FIG. 3, rather than providing a separate housing upper portion 104 and a separate fitment 112, the housing upper portion and the fitment can be produced as a single integral piece, so that the fitment 112 is an integral part of the housing upper portion 104. This can be accomplished using known manufacturing techniques such as injection molding of plastic. In this instance, the expansible bladder 120 can still be fitted over a flared portion 118 as depicted in FIG. 3.

Figure 5:
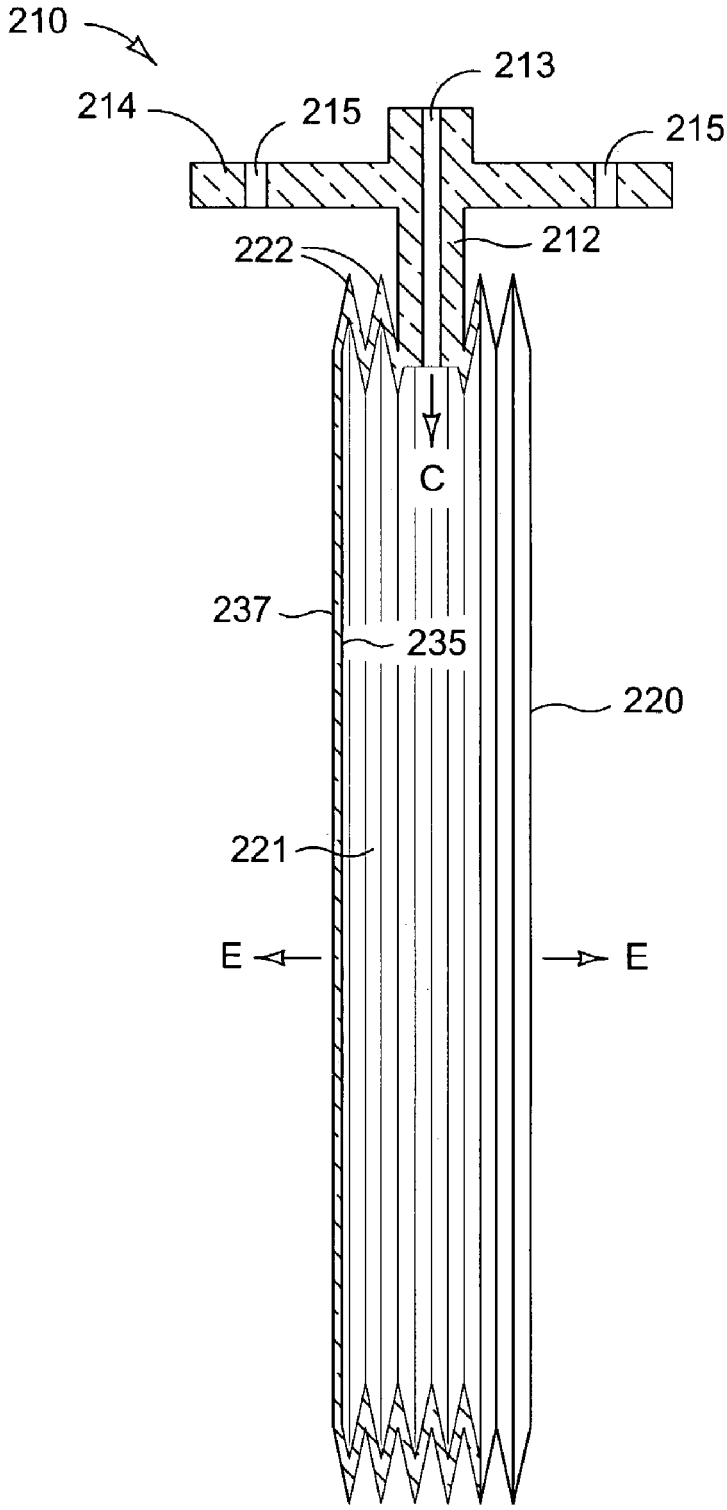
FIG. 5 is a side sectional view depicting an air management system in accordance with another embodiment of the invention.

The ink cartridge depicted in FIG. 3 provides for a two-piece air management system 110 for use in an ink cartridge (the two pieces being the fitment 112 and the expansible bladder 120). In accordance with another embodiment, rather than providing a two-piece air management system for an ink cartridge, a one-piece air management system can be provided. FIG. 5 is a side sectional view depicting one example of a one-piece air management system 210 in accordance with an embodiment of the invention. As will be apparent from the following discussion, the air management system 210 depicted in FIG. 5 can replace the air management system 110 depicted in FIG. 3, and therefore another embodiment of the invention includes an ink cartridge which includes a one-piece air management system as will now be more fully described.

The air management system 210 of FIG. 5 can be a single molding. The air management system/single molding 210 defines a fitment section 212 configured to be supported by a housing of an ink cartridge (such as housing 102 of the ink cartridge 100 of FIG. 3). For example, the fitment section 212 can be provided with one or more mounting holes 215 which can be configured to receive mounting studs, such as mounting studs 109 depicted in FIG. 3. The single molding 210 further defines an expansible bladder section 220, defined by an inner surface 235 and an outer surface 237, and which extends from the fitment section 212. The expansible bladder section 220 is configured to be suspended (by the fitment section 212) in a first fluid reservoir (ink reservoir) of an ink cartridge, such as ink reservoir 101 of FIG. 3. The fitment section 212 has an air passageway 213 defined therein, which allows ambient air to pass into and out of the expansible bladder section 220. In this manner the expansible bladder section 220 of the air management system 210 defines a second fluid reservoir 221, which is configured to contain ambient air (as will be described more fully below). The expansible bladder section 220 is configured to expand in directions "E" to thereby increase the second fluid reservoir 221 from a first volume to a second volume. That is, as ink within an ink cartridge in which the expansible bladder section 220 is supported is removed from the ink cartridge, the expansible bladder section 220 expands to fill the resulting void left by the removed ink, and ambient air moves in direction "C" into the air chamber 221. In order to maintain a slight negative pressure on ink surrounding the expansible bladder section 220, the air management system 210 is fabricated from a material having a shape-memory to thereby bias the expansible bladder section towards the first volume (i.e., in a direction opposite of the arrows "E").

In the example depicted in FIG. 5, the expansible section 220 of the air management system 210 includes a plurality of surfaces which are joined at acute angles to one another to form bellows 222. The bellows configuration of the expansible bladder section 220 allows the bladder section 220 to expand in directions "E" as a result of a vacuum pressure being exerted on the outer surfaces of the bellows 222 (resulting from ink being withdrawn from an ink reservoir in which the bladder 220 is disposed). On the other hand, the shape-memory characteristics of the material from which the air management system 210 is fabricated provides a slight bias in a direction opposite to arrows "E", thus producing the desired negative pressure condition in the ink surrounding the expansible bladder 220. As described previously, a slight negative pressure in the ink reservoir is desirable to reduce ink "drool" from the print head (such as print head 103 of FIG. 3). Further, by venting the air chamber 221 to the atmosphere via the air vent 213 in the fitment section, as ink in a surrounding ink reservoir expands and contracts due to changes in temperature of the ink, a constant pressure will be maintained in the ink reservoir, as established by the shape-memory characteristics of the material from which the air management system 210 is fabricated. In one example the expansible bladder section 220 is configured to expand when the outer surface 237 of the bladder 220 is subjected to a pressure of between about 0.01 psi and 0.50 psi. The bellows 222 depicted in FIG. 5 are shown having a thicker sidewall than would be used in reality to facilitate visualization of the air management system 210. Further, the bellows 222 are depicted in FIG. 5 as being somewhat expanded, whereas initially (i.e., before any ink is removed from an ink cartridge in which the bellows can be placed) the bellows would be essentially collapsed to allow for an increase in ink volume in the ink cartridge.

When the air management system 210 depicted in FIG. 5 is used in an ink cartridge (e.g., replacing the air management system 110 in the ink cartridge 100 of FIG. 3), then the housing of the ink cartridge can be provided with an ink bypass system similar to the ink bypass 130 described above.

Although the surfaces which make up the expansible bladder section 220 of the air management system 210 of FIG. 5 are depicted as forming bellows 222, it will be appreciated that other arrangements can be provided to achieve the same result. Generally, the surfaces which make up the expansible bladder section can be located at acute angles to one another (i.e., generally "folded" with respect to one another) when the expansible bladder is in the collapsed or initial position. This folding of the surfaces allows for reduction of the initial volume of the expansible bladder 220, thus allowing more room for ink in an associated ink cartridge in which the expansible bladder can be disposed. As ink is removed from the cartridge, and the expansible bladder begins to expand, the surfaces which define the expansible bladder begin to "unfold" (i.e., the angles between the surfaces increase). Thus, in addition to forming bellows, the surfaces which make up the expansible bladder section can be formed in one or more pleats, or they can be folded in a "Z"-fold onto one another, or placed in other initial positions to allow expansion of the bladder, but to reduce the volume of the expansible bladder when it is in the collapsed state.

Materials from which the air management system 210 of FIG. 5 can be fabricated include high density polyethylene, low density polyethylene, polyvinyl chloride, and polypropylene. The material selected for fabrication of the air management system should be chemically resistant to ink the expansible bladder section will come into contact with, and should provide the desired shape-memory characteristics described above. Additionally, the selected material for fabrication of the air management system should accommodate a fabrication process that allows a one-piece, single molding, air management system to be fabricated.

Figure 6:
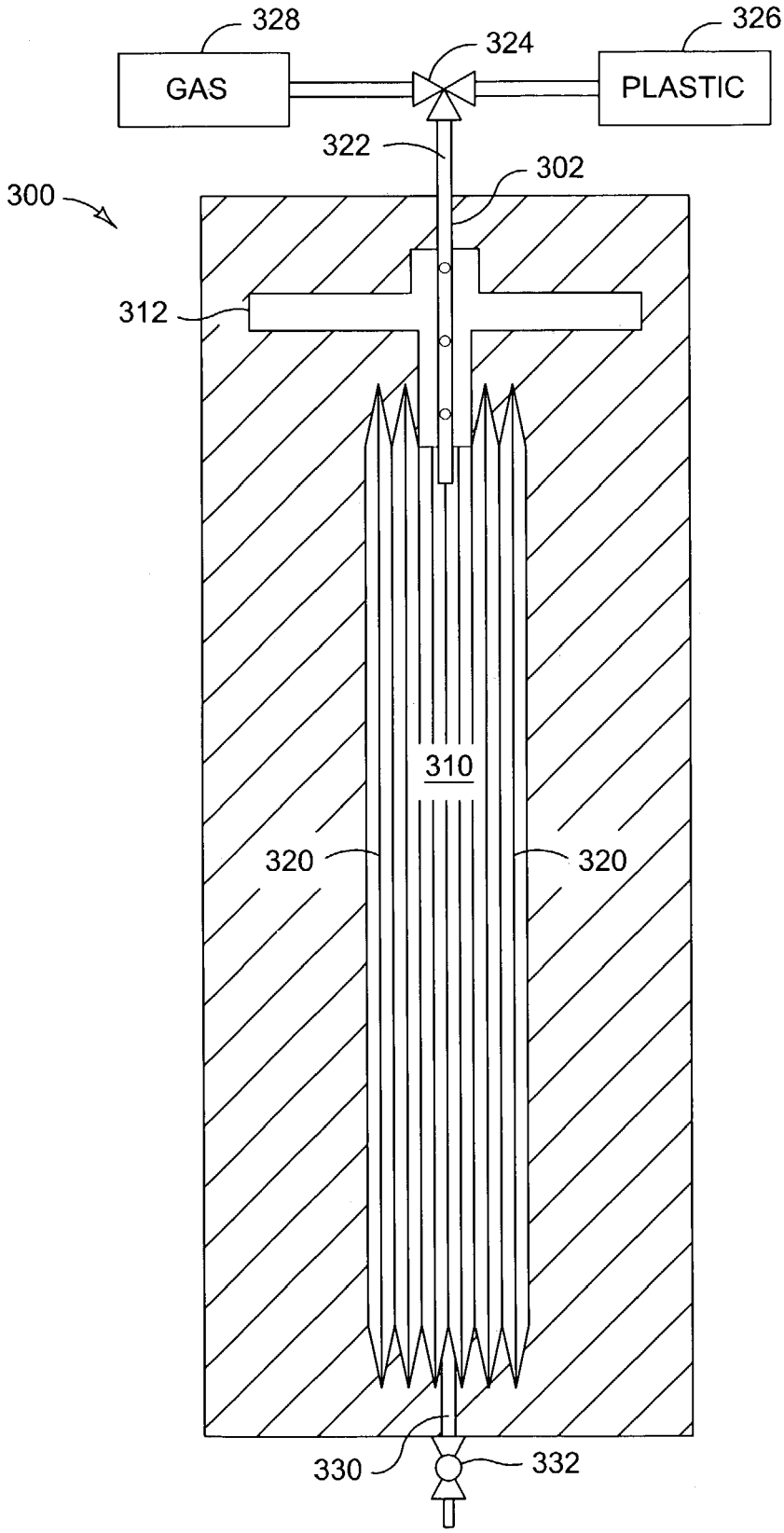
FIG. 6 is a side sectional view depicting a mold that can be used to form the air management system of FIG. 5.

One example of how the air management system 210 depicted in FIG. 5 can be fabricated will now be described. FIG. 6 is a side sectional view depicting a mold 300 that can be used to form the air management system 210 of FIG. 5. The mold 300 defines a single cavity 310, which further defines a fitment section 312 and expansible bladder sections 320. As can be seen by viewing FIGS. 5 and 6 together, the fitment section 312 of the cavity 310 is used to form the fitment 212 of the air management system 210, and the expansible bladder sections 320 of the cavity 310 are used to form the expansible bladder 220 of the air management system 210. The mold 300 of FIG. 6 further includes an inlet opening 302 in which an injection probe 322 can be inserted. The mold 300 further includes an outlet opening 330 which can be selectively opened and closed by an outlet valve 332, the operation of which will be described more fully below. The injection probe 322 is connected to a three-way valve 324, which allows a "plastic" 326, or a "gas" 328, to be selectively injected into the void 310 of the mold via the probe 322. The "plastic" 326 can be any material selected for fabrication of the air management system 210 (FIG. 5), as previously described. One non-limiting example of operating the mold 300 to form an air management system (such as air management system 210 of FIG. 5) will now be described with respect to FIGS. 7A and 7B.

Figure 7A:
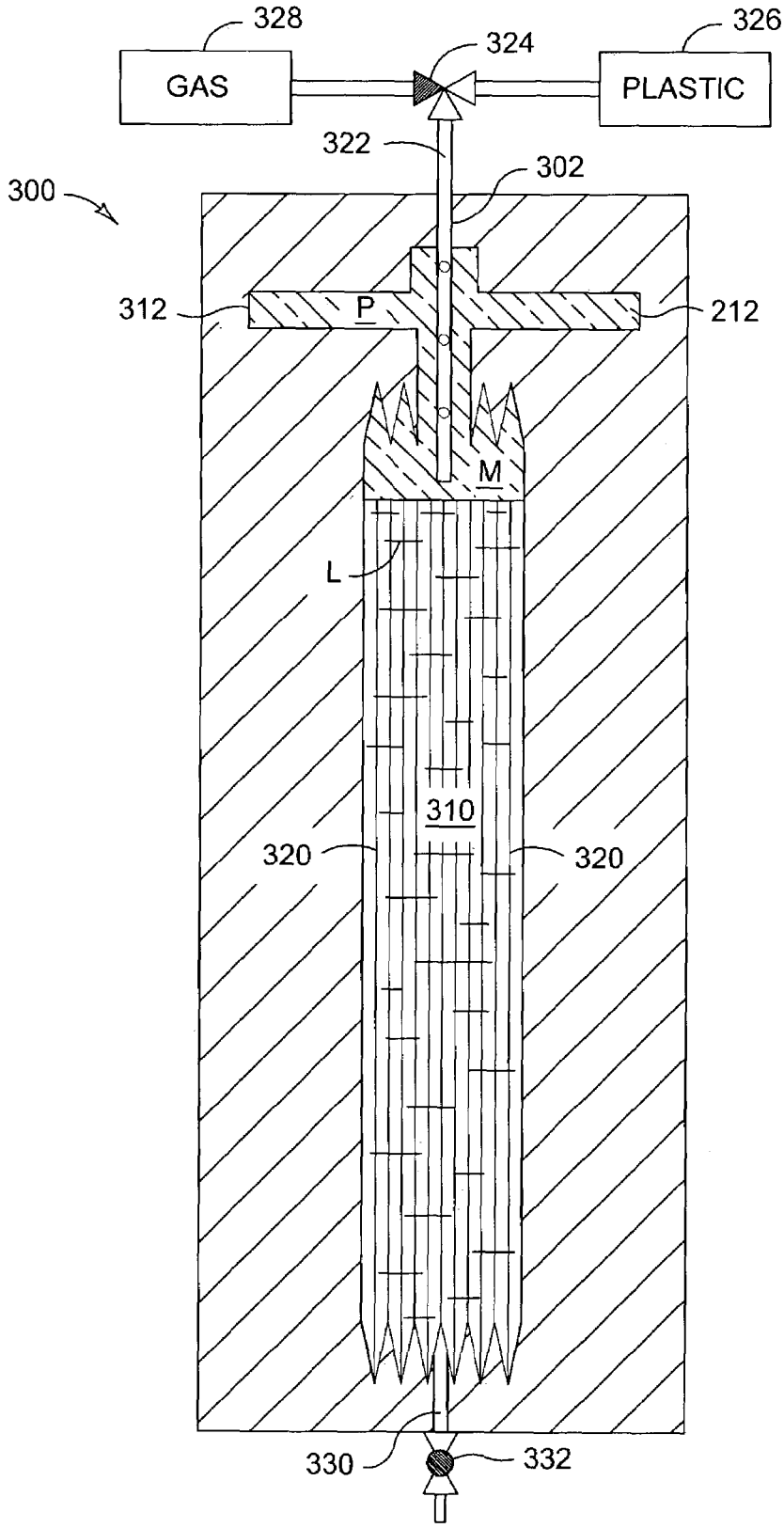
FIGS. 7A and 7B depict steps of forming the air management system of FIG. 5 using the mold depicted in FIG. 6.

In the following example, a single-molding (one-piece) air management system (such as air management system 210 of FIG. 5) is fabricated using a single mold, and a two-step process. In the first step, the fitment of the air management system is injection molded, and in the second step the expansible bladder of the air management system is blow molded. Turning to FIG. 7A, "plastic" 326 has been injection molded into the fitment section 312 of the mold 300 via the probe 322, as indicated by material "P" in fitment section 312, to form the fitment 212 of the air management system 210 (FIG. 5). The three-way valve 324 is closed to the "gas" 328 during this injection molding process. Further, the bulk of the expansible bladder sections 320 of the mold 300 have been filled with a liquid "L" to prevent migration of the "plastic" into the expansible bladder sections 320 during the injection molding process. However, a predetermined volume in the expansible bladder sections 320 is not filled with the liquid "L" to thereby allow a surplus mass "M" of the "plastic" to be injected into the upper portions of the expansible bladder sections 320. (It will be appreciated that traditional venting methods used in injection molding processes can be provided with the mold 300 to allow air within the fitment section 312 and the upper portions of the expansible bladder sections 320 to be vented during the injecting molding process.)

Figure 7B:
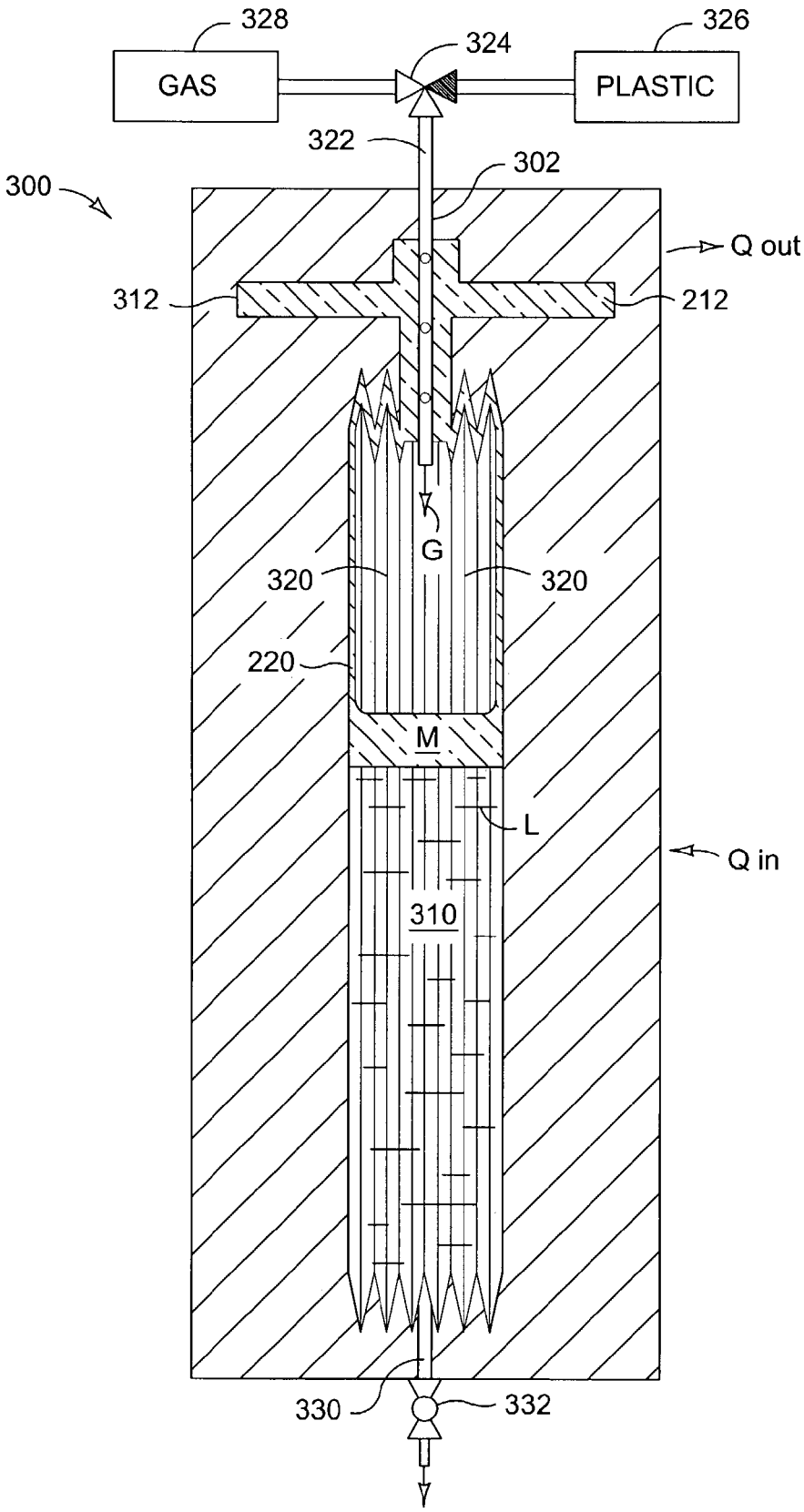

Turning now to FIG. 7B, once the fitment section 312, and the additional mass "M" of the "plastic" have been injected molded into the mold 300, then the outlet valve 332 is opened, allowing the liquid "L" to drain from the expansible bladder sections 320 via the outlet opening 330. Further, the three-way valve 324 is closed to the source of "plastic"326, and the valve 324 is opened to the source of "gas" 328. The "gas" 328 is then blown into the mold 300 via the probe 322. As the gas "G" is blown into the mold 300, the surplus mass "M" of "plastic" is blown into the expansible bladder sections 320 of the mold 300 to form the expansible bladder 220 of the air management system 210 (FIG. 5). The gas "G" (328) is continued to be blown into the mold 300 until the expansible bladder section 220 is completely formed. Thereafter the probe 322 is removed, thereby forming the air vent 213 (FIG. 5) in the fitment 212. The mold 300 can be a split mold (split along the section depicted in FIG. 6), so that the mold can be separated and the resulting fully formed air management system removed.

In order to facilitate formation of the expansible bladder (220, FIG. 5) in the expansible bladder sections 320 of the mold 300 (FIG. 7B), heat "Q" can be added to the expansible bladder sections 320 to maintain the surplus mass "M" of the "plastic" in a moldable state. Heat can be added, for example, by placing an electrical heating coil around the expansible bladder sections 320 of the mold 300. Further, heat can be added by heating the liquid "L". In addition, to facilitate setting of the fitment 212, heat can be removed from the fitment section 312 of the mold 300. Heat can be removed from the fitment section 312 by placing a refrigeration coil around the fitment section 312 of the mold 300, for example.

It will be appreciated that the example depicted in FIGS. 7A and 7B of producing a single molded air management system for use in an ink cartridge is exemplary only, and that other manufacturing processes can be used. For example, the fitment section 212 and the expansible bladder section 220 of the air management system 210 depicted in FIG. 5 can be produced separately (such as by separate respective injection molding and blow molding processes), and then the two components can be joined together by gluing, fusing, ultrasonic welding, heating, etc. That is, the single molded air management system does not have to be produced in a single mold, but when the air management system is completed, it results in a single part which is produced (at least in-part) by a molding process. Further, the fitment section and/or the expansible bladder section can be formed by processes other than molding processes, and the two sections can thereafter be joined together (such as by gluing, fusing, ultrasonic welding, heating, etc.) to thereby form an air management system for use in an ink cartridge, such that the air management system has a fitment section configured to be supported by the ink cartridge, and an expansible bladder section which integrally extends from the fitment section. In this way a one-piece air management system for use in an ink cartridge can be provided, which overcomes the problems associated with the prior art and identified above.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A one-piece air management system for use in an ink cartridge, comprising a fitment section configured to be supported by the ink cartridge, and an expansible bladder section which integrally extends from the fitment section and which defines a fluid reservoir, and wherein the expansible bladder section is configured to expand to thereby increase the fluid reservoir from a first volume to a second volume, and wherein the air management system is fabricated from a material having a shape-memory to thereby bias the expansible bladder section towards the first volume.

2. The one-piece air management system of claim 1, and wherein the air management system is fabricated from a material selected from the group comprising high density polyethylene, low density polyethylene, polyvinyl chloride, or polypropylene.

3. The one-piece air management system of claim 1, and wherein the fitment section has an air passageway defined therein to allow air to enter the expansible bladder portion.

4. An ink cartridge, comprising:

a housing defining a first fluid reservoir;

an air management system comprising a fitment; and a one-piece expansible bladder which defines a second fluid reservoir and which is supported by the fitment within the first fluid reservoir, the expansible bladder being configured to expand to thereby increase the second fluid reservoir from a first volume to a second volume, and wherein the expansible bladder is fabricated from a material having a shape-memory to thereby bias the expansible bladder towards the first volume, and wherein:

the fitment comprises an extension portion, a flared portion, and a recess portion defined between the extension portion and the flared portion;

the fitment is provided with a vent hole to thereby vent the second fluid reservoir to atmosphere; and the one-piece expansible bladder comprises an elastomeric ring portion defining an opening into the one-piece expansible bladder, and the elastomeric ring portion of the one-piece expansible bladder is fitted about the recess portion of the fitment; and the housing comprises a separate upper portion and a separate lower portion configured to be joined together; and the fitment comprises an integral part of the housing upper portion.

5. The ink cartridge of claim 4, and wherein the one-piece expansible bladder is fabricated from a material selected from the group comprising natural rubber, neoprene rubber, nitrile rubber, ethylene-propylene, isobutylene-isoprene, chlorosulphonated polyethylene, viton, silicone rubber; acryl-nitrile butadiene, sytrol-butadiene, or flourosilicone.

6. The ink cartridge of claim 4, and wherein the one-piece expansible bladder is defined by an inner surface and an outer surface, and further wherein the one-piece expansible bladder is configured to expand when the outer surface is subjected to a pressure of between about 0.01 psi and 0.50 psi.

7. The ink cartridge of claim 4, and wherein the housing is defined by an inner surface and an outer surface, the ink cartridge further comprising a raised portion on the inner surface of the housing, the raised portion defining fluid passageways.

8. An ink cartridge, comprising:

a housing defining a first fluid reservoir;

an air management system comprising a fitment supported by the housing; and a one-piece expansible bladder which defines a second fluid reservoir and which is supported by the fitment within the first fluid reservoir, the expansible bladder being configured to expand to thereby increase the second fluid reservoir from a first volume to a second volume, and wherein:

the expansible bladder is fabricated from a material having a shape-memory to thereby bias the expansible bladder towards the first volume; and the one-piece expansible bladder is defined by an inner surface and an outer surface, and further wherein the one-piece expansible bladder is configured to expand when the outer surface is subjected to a pressure of between about 0.01 psi and 0.50 psi; and the housing comprises a separate upper portion and a separate lower portion configured to be joined together; and the fitment comprises an integral part of the housing upper portion.

9. The ink cartridge of claim 8, and wherein the fitment is provided with a vent hole to thereby vent the second fluid reservoir to atmosphere.

10. The ink cartridge of claim 8, and wherein the fitment comprises an extension portion, a flared portion, and a recess portion defined between the extension portion and the flared portion, and further wherein the one-piece expansible bladder comprises an elastomeric ring portion defining an opening into the one-piece expansible bladder, and the elastomeric ring portion of the one-piece expansible bladder is fitted about the recess portion of the fitment.

11. The ink cartridge of claim 8, and wherein the one-piece expansible bladder is fabricated from a material selected from the group comprising natural rubber, neoprene rubber, nitrile rubber, ethylene-propylene, isobutylene-isoprene, chlorosulphonated polyethylene, viton, silicone rubber, acryl-nitrile butadiene, sytrol-butadiene, or flourosilicone.

12. The ink cartridge of claim 8, and wherein the housing is defined by an inner surface and an outer surface, the ink cartridge further comprising a raised portion on the inner surface of the housing, the raised portion defining fluid passageways.

* * * * *